US006257456B1

(12) United States Patent
Haas

(10) Patent No.: US 6,257,456 B1
(45) Date of Patent: Jul. 10, 2001

(54) POWDERING DEVICE

(75) Inventor: Reiner Haas, Metzingen (DE)

(73) Assignee: Weitmann & Konrad GmbH & Co. KG, Leinfedden-Echterdingen (DE)

( * ) Notice: Subject to any disclaimer, the term of this patent is extended or adjusted under 35 U.S.C. 154(b) by 0 days.

(21) Appl. No.: 09/509,348

(22) PCT Filed: Jul. 14, 1999

(86) PCT No.: PCT/EP99/04961

§ 371 Date: Mar. 27, 2000

§ 102(e) Date: Mar. 27, 2000

(87) PCT Pub. No.: WO00/09269

PCT Pub. Date: Feb. 24, 2000

(30) Foreign Application Priority Data

Aug. 10, 1998 (DE) ..... 198 36 013

(51) Int. Cl.[7] ..... A45D 24/22
(52) U.S. Cl. ..... 222/196; 222/199; 222/488
(58) Field of Search ..... 222/196, 199, 222/488

(56) References Cited

U.S. PATENT DOCUMENTS 1,781,603 11/1930 Schori .
2,266,849 12/1941 Cole .
3,490,655 * 1/1970 Ledgett ..... 222/199
4,809,462 3/1989 Hiroshi .

FOREIGN PATENT DOCUMENTS 3 23 339 9/1957 (CH) .
327 747 3/1958 (CH) .
967 368 11/1957 (DE) .
1 086 245 8/1960 (DE) .
1 611 317 1/1971 (DE) .
85 13 987 8/1985 (DE) .
38 11 309 10/1989 (DE) .
40 11 698 9/1991 (DE) .
0 473 829 3/1992 (EP) .
831 348 3/1957 (GB) .

* cited by examiner

*Primary Examiner*—Kevin Shaver
*Assistant Examiner*—David Deal
(74) *Attorney, Agent, or Firm*—Paul Vincent

(57) ABSTRACT

A powder device comprises a powder container which is formed as an exchangeable container mounted on a container receptacle via a quick-connect means. The inside of the powder container has a dome which extends from the output flow opening into the inside of the powder container. This loosens up the powder and prevents it from adhering to surfaces.

22 Claims, 3 Drawing Sheets

POWDERING DEVICE

BACKGROUND OF THE INVENTION

The invention concerns a powder device for powdering printed sheets, comprising a powder container containing powder and from which powder is extracted, wherein the powder device is designed as an exchangeable container which can be removed from the powder device and which has an opening at its lower end which can be closed by a closing element.

There are a plurality of conventional powder devices of this kind. DE 22 52 474 A discloses e.g. a supply container for powder, wherein the lower opening forming the outlet can be closed by a ball. Containers of this type have, however, the essential disadvantage that they are relatively easily blocked, since the powder sticks to the side walls or powder bridges are formed thus preventing further supply of powder from above. GB 15 88 393 B discloses a container having an elastic bottom which is moved via a vibrator. The powder is not drawn off from this container via a lower flow opening, rather suctioned off using a suction air flow. This also has the above-mentioned disadvantages, since the powder adheres, in particular, to the walls and can no longer continue to flow towards the suction nozzle. U.S. Pat. No. 4,051,981 discloses a powder device having a bellows-like supply container, opening into a pin-cushion from which powder can be blown into a blowpipe by compressing the supply container. This device prevents sticking or formation of powder bridges, since the supply container is continuously elastically deformed.

DE 38 11 309 also discloses a supply container for powder, wherein the lower outlet opening is closed by a ball. When powder is required, the ball is pushed into the supply container by an actuating element to loosen up the powder located above the ball which can then flow past the ball in the direction of the outlet opening. Compressed air is blown into the supply container to further loosen up the powder. The container must be sealed in an air-tight manner to prevent the powder from escaping from the supply container.

It is the underlying purpose of the invention to provide an exchangeable powder container which reduces powder build-up on the container walls and which reduces powder bridge formation in the container.

SUMMARY OF THE INVENTION

This object is achieved in accordance with the invention by a finger or dome extending into the inside of the container above the outflow opening.

The lower end of the powder container in accordance with the invention has an outflow opening for discharge of the powder. A finger-like dome is disposed above this outlet opening and is rigidly connected to the powder container. This dome protrudes into the powder in the container to substantially prevent formation of bridges and columns in the powder container and to effect uniform flow of the powder. The vibrations occurring during operation normally cause sufficient shaking of the dome, via the powder container housing, to loosen up the powder and maintain free flow thereof. This also prevents sticking of the powder to the inner walls of the container.

With containers having a truncated cone-shaped lower end passing over into the outflow opening, the dome preferentially has a length or height which is greater than or equal to the length of the truncated cone. The critical area in which the powder is usually compressed, is thereby penetrated by the dome to assure loosening of the powder in this area.

In an advantageous embodiment, the dome has the shape of a sleeve. The dome thereby has a vertical longitudinal axis and extends, in particular, along the axis of the powder container. The sleeve shape has the substantial advantage that the powder can flow through the dome itself. Towards this end, the dome has several transverse bores for passage of the powder into the dome. Powder flow into the dome leads to additional loosening up of the powder supply. The powder in the dome is discharged via the outlet opening. The dome is preferentially disposed such that the powder must initially flow into the dome before reaching the outlet opening.

Advantageously, the upper side of the dome has a pointed tip at the end of the upper side of the dome for distributing the powder, in particular, for breaking-up powder clots located above the dome.

Advantageously, the dome extends over 10% to 80% of the height of the powder container. The dome can thereby be disposed in the container in an exchangeable fashion. This permits e.g. use of different dome designs for different types of powder.

In a further development of the powder container, the closing element is formed as a flap extending away from the output flow opening. This flap closes the container opening from the outside and is withdrawn when the powder container is opened. This has the essential advantage that the powder in the container is not additionally compressed when the powder container is opened and relatively little force is required to open or move the flap. When the container is opened, it can be easily closed again by seating the flap on the outflow opening.

In one embodiment in accordance with the invention, the flap is supported pivotably, in particular, on the powder container. It is also feasible to design the closing element as a slide element which opens the container opening via a sliding motion.

The flap is preferably disposed on the opening under the force of a restoring spring, wherein the spring force closes the opening. The spring force is thereby sufficiently large that the flap does not open under the weight of the powder. Moreover, the flap prevents outflow of powder, in particular when the container is replaced or filled.

In a preferred variant of the invention, the flap can be actuated by means of a drive. This drive is disposed at the powder container receptacle and is designed, in particular, as a tappet drive. Other drives are feasible, e.g. magnetic drives, pneumatic or hydraulic drives or the like.

In one embodiment, the flap comprises a spherical body for sealing the opening of the container. This has the essential advantage that the opening can be sealed to an optimum degree and the discharged powder can easily flow around the flap. Powder, which could impair re-sealing of the container, does not remain on the flap.

Preferably, the powder device comprises a quick-connect means for securing the powder container. This quick-connect means facilitates easy and fast removal of an empty powder container from the powder device for either re-filling or replacement with a full powder container. The removal or mounting of the powder container can be done without tools.

Improved loosening of the powder within the container via the dome can be effected by connecting the powder container to a means for setting it into vibration, in particular a vibrator. This vibrator may be operated either continuously or in defined intervals. The vibrator may thereby comprise e.g. a counterweight or a magnetic oscillator.

Further advantages, features and details of the invention can be extracted from the dependent claims and the following detailed description of a particularly preferred embodiment with reference to the drawing. The features shown in the drawing, recited in the claims, and delineated in the description may be essential to the invention either individually or collectively in arbitrary combination.

DESCRIPTION OF THE PREFERRED EMBODIMENT

Figure 1:
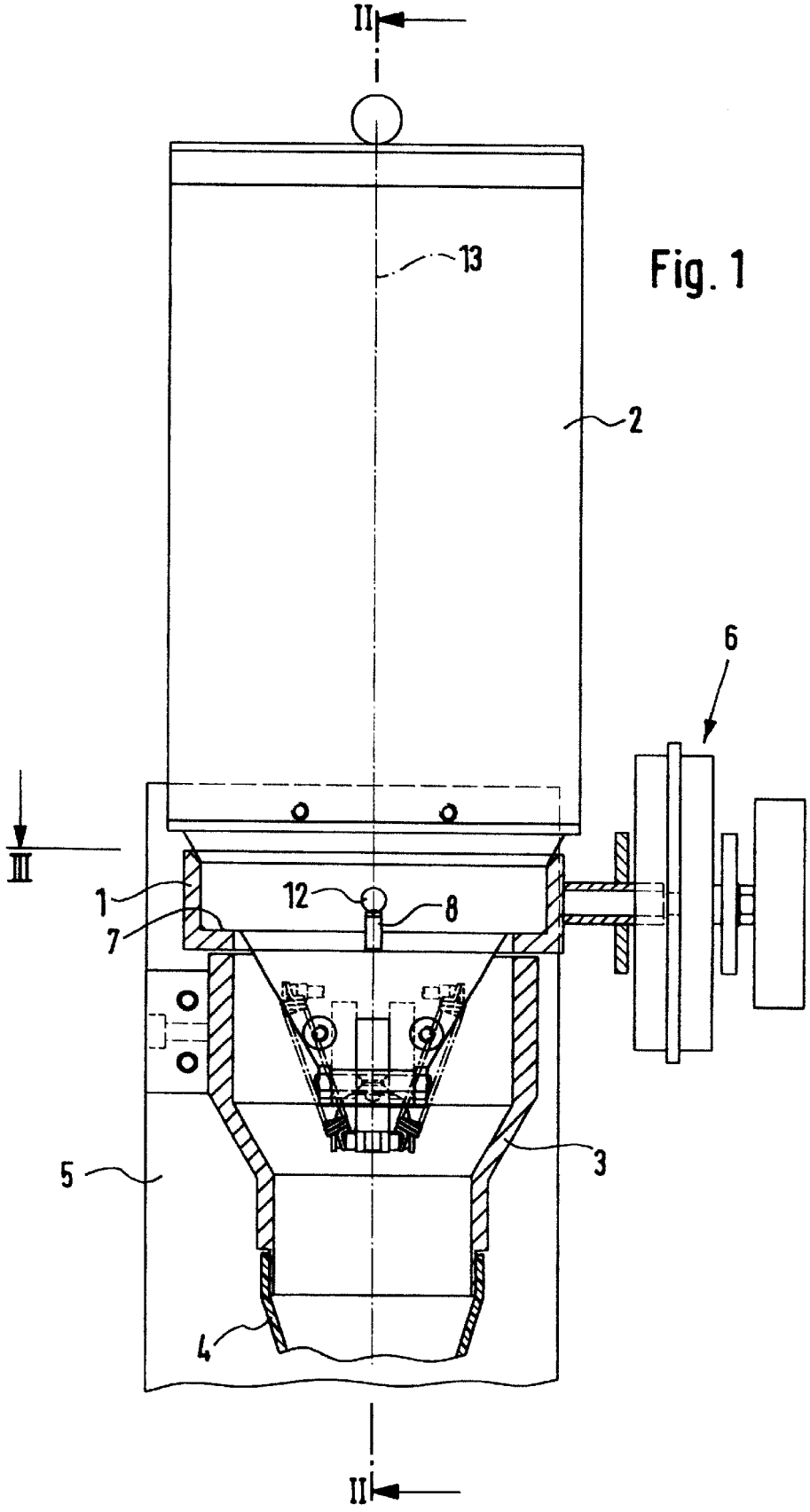
FIG. 1 shows a side view of an exchangeable container inserted into the container receptacle.

FIG. 1 shows a container receptacle 1 for an exchangeable container 2 containing powder. The container receptacle 1 is shown in a longitudinal sectional view. A funnel-shaped connecting piece 3 is disposed below the container receptacle 1 which opens into an intermediate container 4 made from an elastic material e.g. rubber or the like. The container receptacle 1 and the connecting piece 3 are mounted to a mounting plate 5.

A vibrator 6 is mounted to the container receptacle 1 for vibration thereof. The vibrator 6 contains an oscillator driven via magnetic forces. The vibrator 6 may thereby be driven continuously, in predetermined time intervals, or as required.

The container receptacle 1 comprises an annular radially inward projecting receiving shoulder 7 onto which the exchangeable container 2 is disposed. A receiving shoulder 7 pin 8 thereby engages into an opening 9 (FIG. 2) disposed in the exchangeable container 2. The opening 9 is located at a funnel-shaped container neck 10, in particular, at an annular attachment 11 seating precisely within the annular receiving shoulder 7. This attachment 11 is furthermore provided with a radially extending opening, disposed, with respect to the longitudinal axis 13 of the exchangeable container 2, opposite to the opening 9. A spring-loaded pin 14, borne for displacement, engages in this opening 12. This pin 14 is disposed on a tensioning knob 15 for radial withdrawal from the opening 12. The exchangeable container 2 is thereby fixed in the container receptacle 1 via the two pins 8 and 14.

The upper end 16 of the container neck 10 maps into a container housing 17, closed by a lid 18. The upper end of the exchangeable container 2 must not be air-tight. The lower end 19 of the container neck 10 has an outflow opening 20 through which the powder contained in the exchangeable container 2 can flow out of the container in a downward direction. A dome 21 is inserted into the outflow opening 20 and extends upwardly in the direction of the longitudinal axis 13, i.e. into the inside of the container. The outflow opening 20 is closed by a flap 22 supported for pivoting about an axis 23. The axis 23 is located at a projection 24 of the container neck 10 and supports a pivoting lever 25 in a rocker-like manner which can be actuated at the upper end via a tappet drive 26. The other end is offset and comprises a spherical sealing body 27 at its free end which closes the outlet opening 20 from the outside. When the tappet drive 26 actuates the pivoting lever 25 (dotted lines), the spherical sealing body 27 moves away from and opens the outflow opening 20 it so that the powder can flow out.

The dome 21 disposed in the outflow opening 20 is formed by a sleeve 28 having four transverse bores 29 distributed about the circumference and disposed in four stacked planes. The upper end of the dome 21 is closed with a pointed tip 30. The powder contained in the exchangeable container 2 thereby flows through the transverse bores 29 into the sleeve 28 of the dome 21 and exits same downwardly into the intermediate container 4 when the outflow opening 20 is open.

Figure 2:
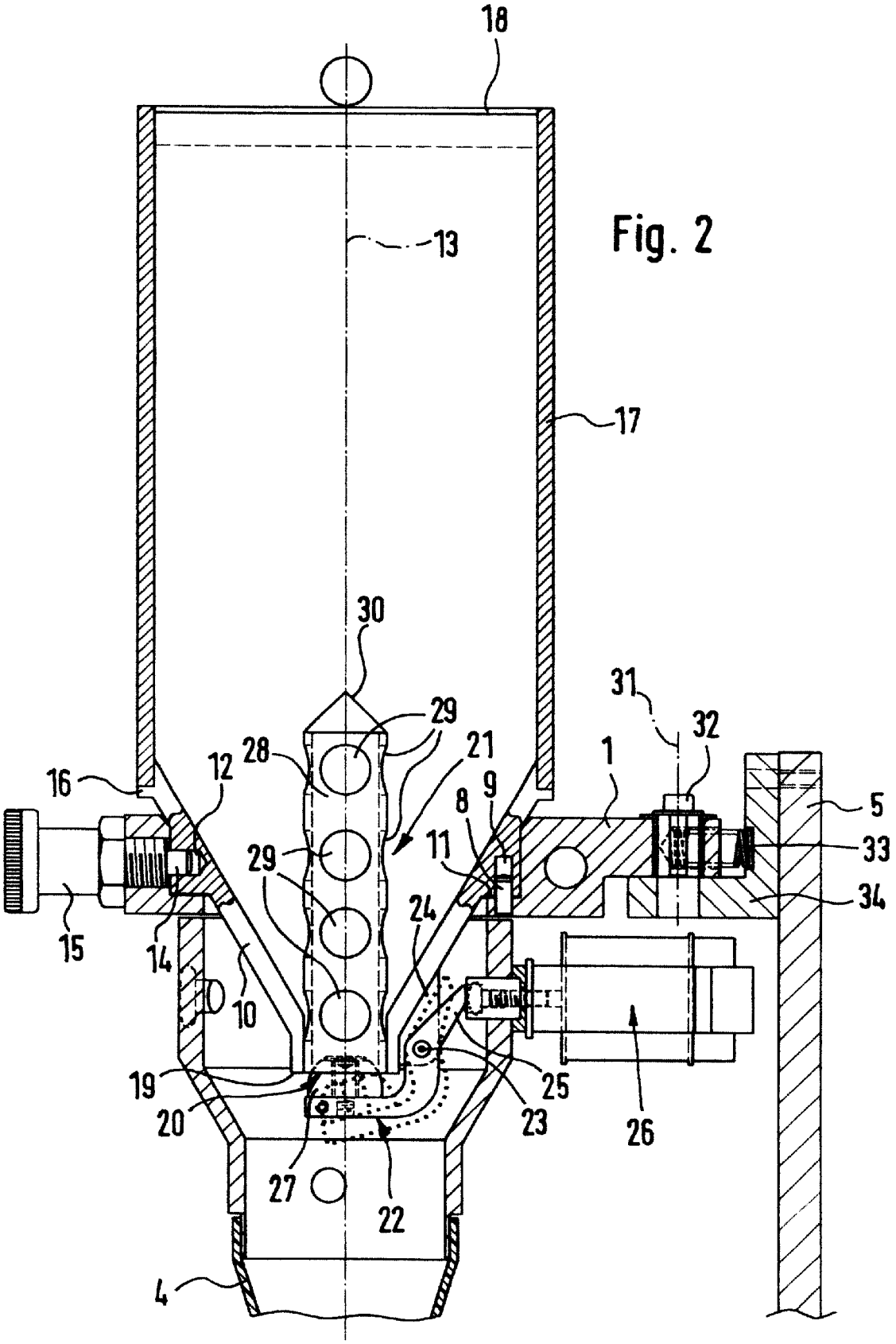
FIG. 2 shows a longitudinal section II—II, according to FIG. 1, through the exchangeable container.
Figure 3:
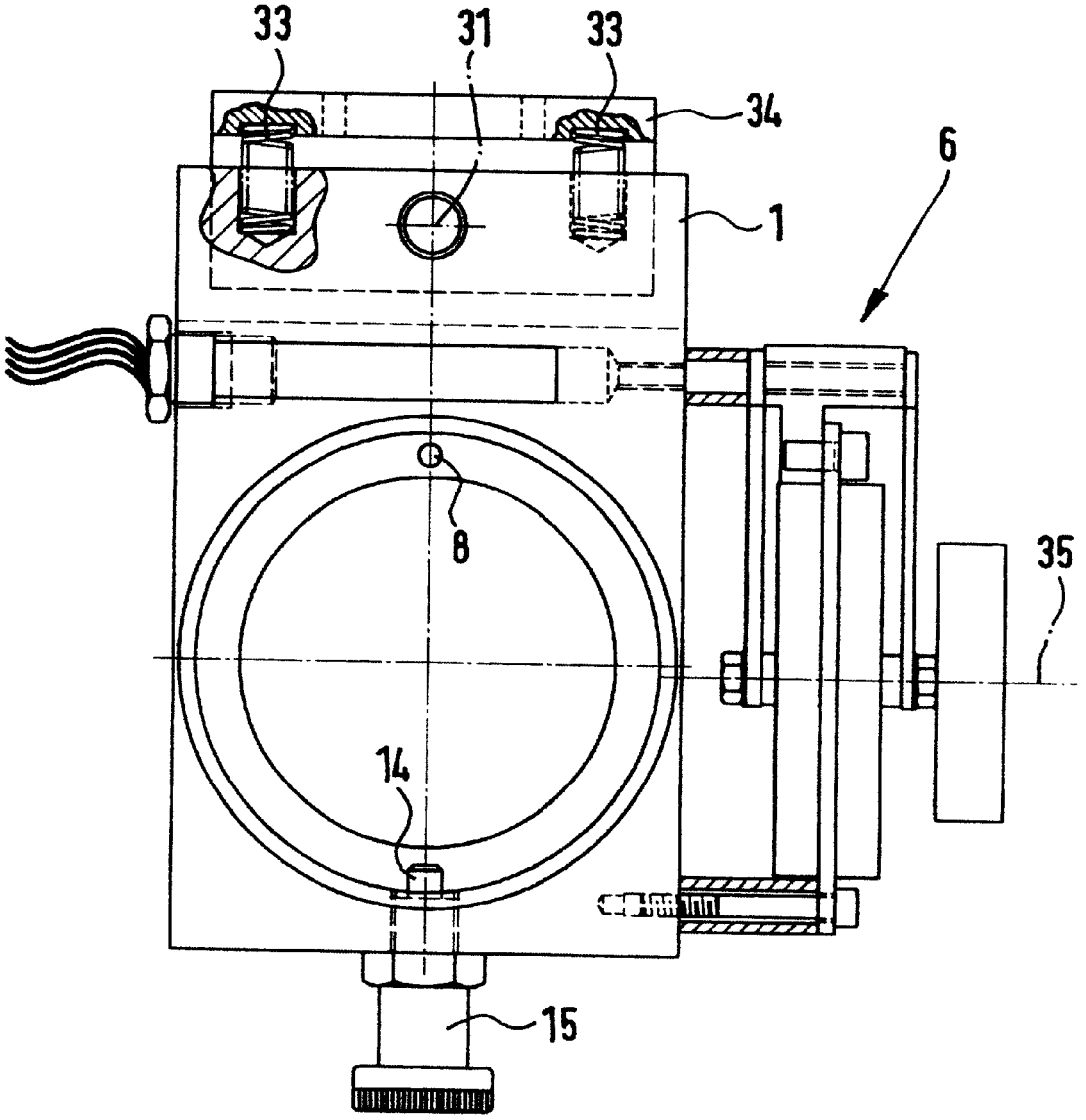
FIG. 3 shows a view III onto the container receptacle in accordance with FIG. 1.

As shown in FIGS. 2 and 3, the container receptacle 1 is borne by a pin 32 for pivoting about a vertical axis 31. A stable seating position of the container receptacle 1 is assured via two horizontally supported pressure springs 33 interposed laterally next to the pin 32 between the mounting plate 5 or a retaining angle 34 and the container receptacle 1. The vibrator 6 thereby generates vibrational motion to shake the container receptacle 1 about the axis 31. The powder in the exchangeable container 2 is loosened up by the dome 21 and maintained in a pourable or sprayable state.

As shown in particular in FIG. 3, the horizontal longitudinal axis 35 of the vibrator 6, corresponding to the direction of motion of an oscillator, is perpendicular to the axis of oscillation 31 of the container receptacle 1 and is disposed at a distance therefrom such that the container receptacle 1 is shaken when the vibrator 6 is active.

What is claimed is:

1. A powder device for powdering printed sheets, the device comprising:

an exchangeable powder container having an opening at a lower end thereof;

a closing element cooperating with said container to close and open said opening; and a dome disposed within said container above said opening to extend from said opening into an inside of said container, wherein at least one of said container and the powder device comprise means for removing said container from the device.

2. The device of claim 1, wherein at least one of said container and the powder device comprise means for removing said container from the device.

3. The powder of claim 1, wherein said dome is sleeve-shaped.

4. The powder of claim 1, wherein said dome has a vertical, longitudinal axis.

5. The powder of claim 1, wherein said dome has a plurality of transverse bores through which powder can flow into said dome.

6. The powder of claim 1, wherein said dome has a pointed tip at an upper end thereof.

7. The powder of claim 1, wherein said dome extends through 10% to 80% of a height of said powder container.

8. The powder device of claim 1, wherein said container has a neck at a lower portion thereof, said neck tapering a container wall in a direction toward said opening.

9. The powder device of claim 8, wherein said dome extends beyond a height of said neck.

10. The powder device of claim 1, wherein said closing element comprises a flap extending away from said opening.

11. The powder device of claim 10, wherein said closing element comprises means bearing said flap for pivoting.

12. The powder device of claim 10, wherein said closing element comprises a spring for urging said flap to close said opening.

13. The powder device of claim 11, wherein said closing element comprises a spring for urging said flap to close said opening.

14. The powder device of claim 10, wherein said flap is borne on said powder container.

15. The powder device of claim 10, further comprising drive means communicating with said flop to open and close said opening.

16. The powder device of claim 15, further comprising a container recepticle for holding said container, wherein said drive means is mounted to said container receptacle.

17. The powder device of claim 15, further comprising a housing having a container recepticle for holding said container and a downwardly extending connector member, wherein said drive means is mounted to said connector member.

18. The powder device of claim 10, wherein said flap comprises a spherical sealing body for said opening.

19. The powder device of claim 10, wherein said flap closes a lower end of said dome.

20. The powder device of claim 1, wherein said removing means comprises a quick-connect means for releasing, by hand, said container from the device.

21. The powder device of claim 20, wherein said quick-connect means comprises a tensioning knob and a pin.

22. The powder device of claim 1, further comprising means for vibrating the powder device.

* * * * *